US007490471B2

(12) United States Patent
Lynch et al.

(10) Patent No.: US 7,490,471 B2
(45) Date of Patent: Feb. 17, 2009

(54) SWIRLER ASSEMBLY

(75) Inventors: John J. Lynch, Greenville, SC (US); Kevin McMahan, Greer, SC (US); Mark Pinson, Greer, SC (US)

(73) Assignee: General Electric Company, Schenectady, NY (US)

( * ) Notice: Subject to any disclaimer, the term of this patent is extended or adjusted under 35 U.S.C. 154(b) by 501 days.

(21) Appl. No.: 11/164,861

(22) Filed: Dec. 8, 2005

(65) Prior Publication Data

US 2007/0130954 A1 Jun. 14, 2007

(51) Int. Cl.
*F02C 1/00* (2006.01)

(52) U.S. Cl. ..... 60/748; 60/776

(58) Field of Classification Search ..... 60/776, 60/748, 737, 772; 239/399, 403; 415/114, 415/115; 416/96 R, 96 A, 97 R
See application file for complete search history.

(56) References Cited

U.S. PATENT DOCUMENTS

| | | | | |
|---|---|---|---|---|
| 4,245,462 | A * | 1/1981 | McCombs, Jr. | 60/790 |
| 5,408,830 | A * | 4/1995 | Lovett | 60/737 |
| 6,438,961 | B2 | 8/2002 | Tuthill et al. | 60/776 |

* cited by examiner

*Primary Examiner*—Michael Cuff
*Assistant Examiner*—Andrew Nguyen
(74) *Attorney, Agent, or Firm*—Sutherland Asbill & Brennan LLP

(57) ABSTRACT

A swirler assembly. The swirler assembly may include a hub, a vane positioned on the hub, and a fuel supply passageway extending from the hub through the vane. The fuel supply passageway may include a substantially triangular shape.

12 Claims, 2 Drawing Sheets

SWIRLER ASSEMBLY

TECHNICAL FIELD

The present application relates generally to gas turbine engines and more particularly relates to an improved air/gas swirler assembly for use about a combustor of a gas turbine engine.

BACKGROUND OF THE INVENTION

Gas turbine engines generally include a compressor for compressing an incoming airflow. The airflow is mixed with fuel and ignited in a combustor for generating hot combustion gases. The combustion gases in turn flow to a turbine. The turbine extracts energy from the gases for driving a shaft. The shaft powers the compressor and generally another element such as an electrical generator. The exhaust emissions from the combustion gases generally are a concern and may be subject to mandated limits. Certain types of gas turbine engines are designed for low exhaust emissions operation, and in particular, for low NOx (nitrogen oxides) operation with minimal combustion dynamics, ample auto-ignition, and flame holding margins.

Low NOx combustors are typically in a form of a number of burner cans circumferentially adjoining each other around the circumference of the engine. Each burner may have one or more swirlers positioned therein. The swirlers may have a number of circumferentially spaced apart vanes for swirling and mixing the compressed airflow and the fuel as they pass therethrough.

One issue with known swirlers is that the gas flow therethrough may be unbalanced among the several vanes. A flow imbalance may cause uneven burning. Such uneven burning may result in an increase in emissions and possibly combustion dynamics. Rather, the goal is to promote a homogeneous flow through the swirlers so as to provide a sufficient combustion process while producing fewer emissions.

There is a desire, therefore, for a gas turbine engine with improved fuel/air mixing and, in particular, improved flow through the swirlers.

SUMMARY OF THE INVENTION

The present application thus describes a swirler assembly. The swirler assembly may include a hub, a vane positioned on the hub, and a fuel supply passageway extending from the hub through the vane. The fuel supply passageway may include a substantially triangular shape.

The swirler assembly may include a number of vanes. The gas flow through each of the vanes may be largely in balance. Each of the vanes may include a fuel supply passageway. The fuel supply passageway may include a substantially triangular entrance and/or the fuel supply passageway may have the substantially triangular shape throughout.

The fuel supply passageway leads to a number of fuel injection holes on the vane. The fuel injection holes may be positioned on the pressure side and/or the suction side of the vane. A shroud may be connected to the vane.

The present application further provides a method of operating a swirler having a hub and a number of vanes. The method may include providing a triangularly shaped fuel supply passage on the hub for each of the number of vanes, flowing gas through the hub and into each of the fuel supply passage in a balanced manner, and swirling the number of vanes. The method further may include swirling a number of swirlers.

These and many other features of the present application will become apparent to one of ordinary skill in the art upon review of the following detailed description of the invention when taken in conjunction with the drawings and the appended claims.

DETAILED DESCRIPTION

Figure 1:
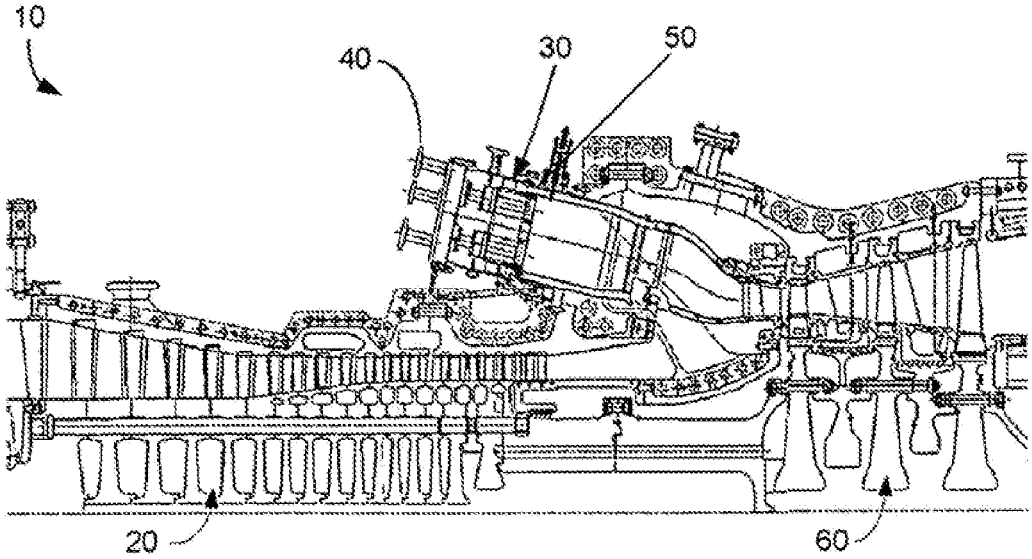
FIG. 1 is a side cross-sectional view of a gas turbine engine.

Referring now to the drawings, in which like numbers represent like elements throughout the several views, FIG. 1 shows a cross-sectional view of a gas turbine engine 10. As was described above, the gas turbine engine 10 includes a compressor 20 to compress an incoming airflow. The compressed airflow is then delivered to a combustor 30 where it is mixed with fuel from a number of incoming fuel lines 40. The combustor 30 may include a number of combustor cans or burners 50. As is known, the fuel and the air may be mixed within the combustor cans or burners 50 and ignited. The hot combustion gases in turn are delivered to a turbine 60 so as to drive the compressor 20 and an external load such as a generator and the like A known combustor can or burner 50 is shown in commonly owned U.S. Pat. No. 6,438,961. As is described therein and shown in FIGS. 2 and 3 herein, the combustor can 50 may include one or more swirlers 70 (described as the swozzle assembly 2 in U.S. Pat. No. 6,438,961). U.S. Pat. No. 6,438,961 is incorporated herein by reference.

Figure 2:
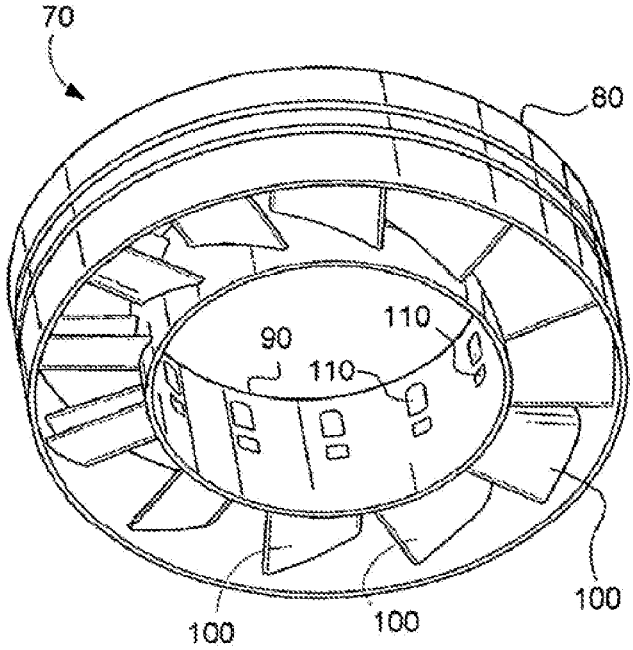
FIG. 2 (PRIOR ART)
FIG. 2 is a perspective view of a known swirler assembly.
Figure 3:
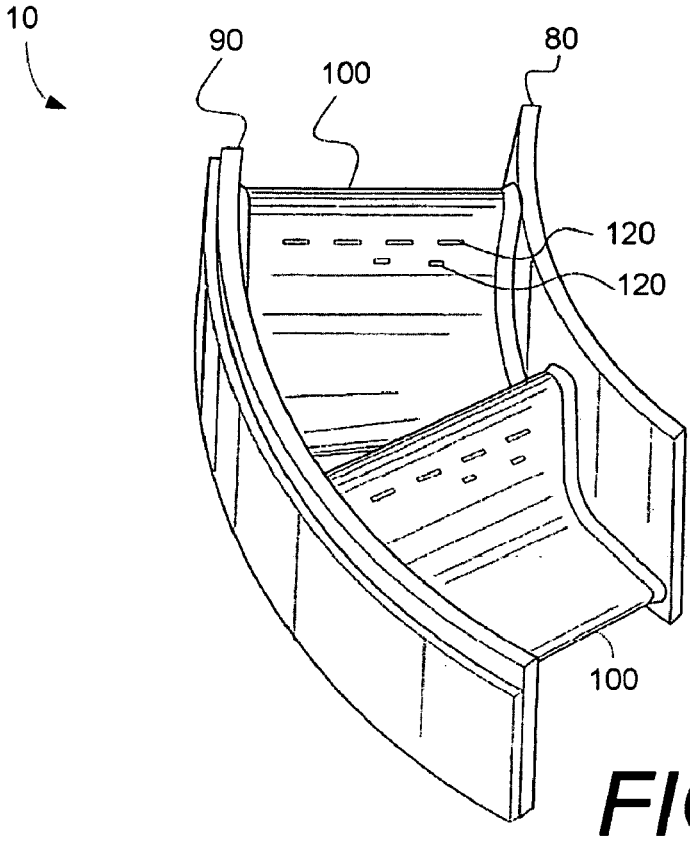
FIG. 3 is a perspective view of the vanes of the swirler assembly of FIG. 2.

As is shown in *Figs*. 2 and 3, each swirler 70 includes a hub 80 and a shroud 90 connected by a series of airfoil shaped turning vanes 100. A number of vanes 100 may be used herein. The vanes 100 swirl the combustion gases passing therethrough. Each vane 100 includes one or more natural gas fuel supply passages 110 extending through the core of the airfoil. Generally described, known fuel supply passages 100 usually are substantially rectangular in shape. The use of a slightly curved end is shown in FIG. 2. The fuel supply passages 110 distribute the natural gas through the vanes 100 to a number of fuel injection holes 120. The fuel injection holes 120 are positioned on the wall of the vanes 100. The fuel injection holes 120 may be located on the pressure side, the suction side, and/or on both sides of the vanes 100. As is known, the natural gas exits the fuel injection holes 120 and is mixed with the incoming compressed airflow.

Figure 4:
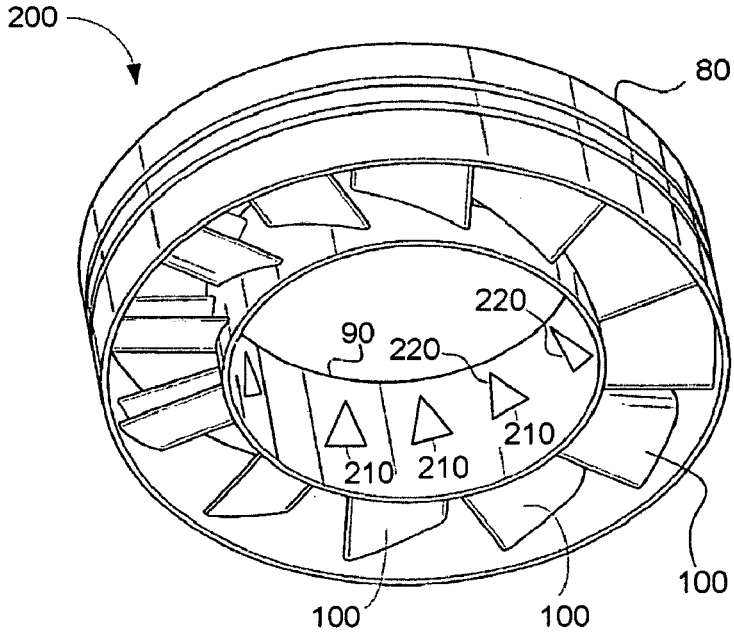
FIG. 4 is a perspective view of a swirler assembly as is described herein.

FIG. 4 shows an improved swirler assembly 200 as is described herein. The swirler assembly 200 includes the hub 80, the shroud 90, and the vanes 100. The swirler assembly 200, however, also includes a number of largely triangularly shaped fuel supply passages 210. The fuel supply passages 210 are largely triangularly shaped so as to cause the gas flow to enter in a substantially straight manner. This straight flow path generally reduces any flow imbalance among the vanes 100. The fuel supply passages 210 may have the triangular shape at an entrance 220 thereof and/or throughout the length of the passage. The triangular fuel supply passages 210 extend through the vanes 100 and lead to the fuel injection holes 120. In this example, three (3) fuel injection holes may be used although any number may be accommodated.

The triangular fuel supply passages 210 thus provide a more uniform fuel flow through each of the vanes 100 of the swirler assembly 200 as a whole. As a result, the flow through each of the vanes 100 is largely in balance. Further, the use of the triangular fuel supply passages 210 also provides more uniform fluid flow through all of the swirlers 200 as a group. The conventional fuel supply passages 110 also may be used in combination herein.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

What is claimed is:

1. A swirler assembly in a gas turbine combustor comprising:

a hub;

a vane positioned on the hub;

and a fuel supply passageway in fluid communication with a fuel source extending from the hub through the vane;

wherein the fuel supply passageway comprises a triangularly shaped cross section.

2. The swirler assembly of claim 1, further comprising a plurality of vanes.

3. The swirler assembly of claim 2, further comprising a balanced gas flow through each of the plurality of vanes.

4. The swirler assembly of claim 2, wherein each of the plurality of vanes comprises a fuel supply passageway.

5. The swirler assembly of claim 1, wherein the fuel supply passageway comprises a substantially triangular entrance.

6. The swirler assembly of claim 1, wherein the fuel supply passageway comprises the substantially triangular shape throughout.

7. The swirler assembly of claim 1, wherein the fuel supply passageway leads to a plurality of fuel injection holes on the vane.

8. The swirler assembly of claim 7, wherein one or more of the fuel injection holes are positioned on a pressure side of the vane.

9. The swirler assembly of claim 7, wherein one or more of the fuel injection holes are positioned on a suction side of the vane.

10. The swirler assembly of claim 1, further comprising a shroud connected to the vane.

11. A method of operating a swirler in a gas turbine combustor having a hub and a number of vanes, comprising:

providing a triangularly shaped cross section fuel supply passage on the hub through each of the number of vanes;

the fuel supply passage in fluid communication with a fuel source;

flowing gas through the hub and into each of the fuel supply passages in a balanced manner; and imparting swirl to the flow of gas via the number of vanes.

12. The method of claim 11, further comprising imparting swirl via a number of swirlers.

* * * * *